US006145220A

United States Patent [19]

Johnson, Jr. et al.

[11] Patent Number: 6,145,220

[45] **Date of Patent: *Nov. 14, 2000**

[54] CUSHIONED FOOTWEAR AND APPARATUS FOR MAKING THE SAME

[75] Inventors: William C. Johnson, Jr., Clarksville; William G. Thomas, Hermitage, both of Tenn.

[73] Assignee: Georgia Boot, Inc., Franklin, Tenn.

[ * ] Notice: Under 35 U.S.C. 154(b), the term of this patent shall be extended for 550 days.

[21] Appl. No.: 08/562,009

[22] Filed: Nov. 22, 1995

[51] Int. Cl.[7] ..... H43B 21/00

[52] U.S. Cl. ..... 36/34 R; 36/30 R; 36/37

[58] Field of Search ..... 36/30 R, 30 A, 36/34 R, 35 R, 37, 76 R, 24.5

[56] References Cited

U.S. PATENT DOCUMENTS

| | | | |
|---|---|---|---|
| 1,717,122 | 6/1929 | Schaff | 36/37 |
| 1,718,906 | 6/1929 | Hurley | 36/37 |
| 1,724,349 | 8/1929 | Haag | 36/37 |
| 1,781,715 | 11/1930 | Blakely | 36/37 |
| 1,973,105 | 9/1934 | Rohn et al. | 36/37 |
| 1,993,208 | 3/1935 | Cohn | 36/37 |
| 2,607,061 | 8/1952 | Leahy et al. | 36/24.5 |
| 5,179,791 | 1/1993 | Lain . | |
| 5,311,677 | 5/1994 | Mann et al. | 36/35 R |

FOREIGN PATENT DOCUMENTS

| | | | |
|---|---|---|---|
| 51380 | 12/1911 | Austria | 36/37 |

OTHER PUBLICATIONS

Advertisement, "with Comfort Core", Georgia Boot, Inc.

*Primary Examiner*—M. D. Patterson
*Attorney, Agent, or Firm*—Milton Wolson

[57] ABSTRACT

Improved cushioned footwear of the type in which, in the past, nails, such as heel nails, gang nails and/or heel seat nails extended into the heel area of the footwear and/or in which, in the past, such footwear included a rigid shank which extended into the heel area, is formed with an opening in the heel area. The heel plug of a cushioning element is placed in the opening. The apparatus for forming the opening is also disclosed.

23 Claims, 9 Drawing Sheets

FIG. 2
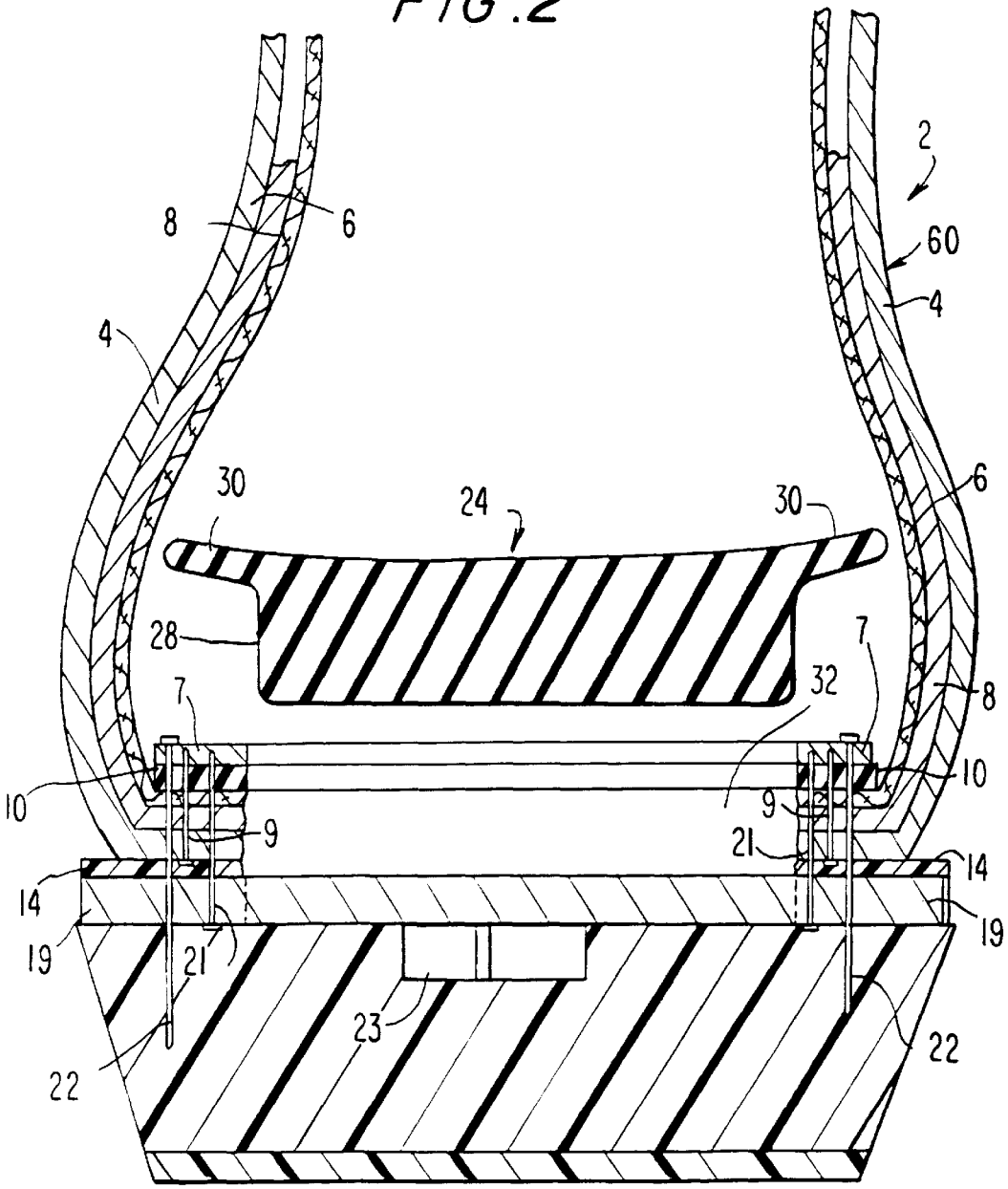
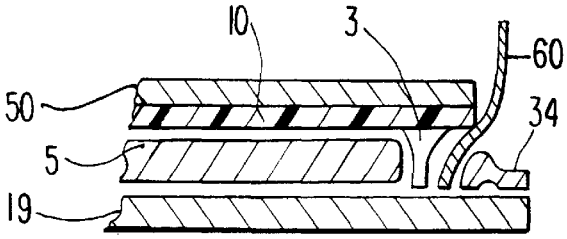
FIG. 3

CUSHIONED FOOTWEAR AND APPARATUS FOR MAKING THE SAME

BACKGROUND OF THE INVENTION

1. Field of the Invention

The present invention relates generally to improved cushioned footwear of the type such as goodyear welt constructed footwear and the apparatus for making such footwear. Unlike prior art footwear of this type, the presence of the cushioning means in the present invention requires only an insignificant increase in the size of the upper and thus is particularly useful in footwear such as western boots, where the aesthetic appearance is a significant element in the marketability of the footwear.

2. Description of the Prior Art

It is well known to include cushioning means in footwear to provide greater comfort to the wearer. Cushioning means in the heel area have been particularly effective in dampening forces and relieving the symptoms of bone jarring while walking or running. One such cushioning means, which is substantially identical to the cushioning means disclosed herein, has been sold by Georgia Boot Inc., the assignee of the present invention, under the "Comfort Core" trademark. This cushioning means and the footwear within which it is used is described in pending U.S. patent application Ser. No. 08/101,964 "Shoe with Insole as Part Sole Filler and Method of Making Same". The assignee of the present application is also the assignee of the aforementioned application.

Such prior art cushioning means have been formed of open or closed cell foam in various thicknesses. The foam has usually been bonded to the insole while still in sheet form or separately included as an insert after the footwear was produced. In addition to the cushioning means noted above, certain other such cushioning means have included discrete heel cushioning means (see, for example, U.S. Pat. No. 1,718,906, issued to E. F. Hurley for "Cushion Heel Shoe"). Prior art footwear utilizing cushioning means have included cavities in the outsole in which the cushioning means were placed. One such means for forming the cavity in the outsole is disclosed in U.K. Pat. No. 144091 to Griggs et al. for "Footwear".

Certain prior art footwear, exemplified by goodyear welt constructed footwear, have not previously utilized a cushioning means having a heel plug located within a cavity in the heel area. The reasons for not doing so included the fact that the presence of nails in the heel area of such footwear led shoe designers away from attempting to provide a heel cavity in the heel area. The nails in the heel area included heel nails for securing the heel to the footwear and/or heel seat nails for securing the tuck, insole, lining, counter and upper and/or gang nails for securing the outsole, rand, upper, counter, lining insole and tuck. In addition, such prior art footwear typically included a rigid shank which extended into the heel area, and this, too, led shoe designers away from attempting to provide a heel cavity in the heel area. It is to the prior art devices discussed in this paragraph that the present invention is directed.

Prior art footwear formed by goodyear welt construction did have heel cushioning means, but these cushioning means were typically not located in heel cavities in the heel area; they were merely placed on the innersole. To accommodate the cushioning means in such footwear, the usual practice was to increase the size of the upper to accommodate a last that had the heel cushioning means thickness added thereto. That practice, however, resulted in a distorted appearing upper and was not aesthetically satisfactory. In another approach, the size of the footwear was increased, perhaps by a half or an entire size to accommodate the added thickness of the cushioning means. This, however, resulted in a loose fitting footwear.

SUMMARY OF THE INVENTION

The present invention is incorporated in footwear of the type in which, in the past, nails had extended through a portion of the heel area of the footwear and/or in which, in the past, a shank had extended laterally into the heel area of the footwear. According to the present invention, an opening or cavity is provided in the heel area of such footwear for insertion of a heel cushioning element. The nail pattern used in such footwear is selected to avoid the presence of nails in the heel area opening and the shank is designed so that it does not interfere with the insertion of the heel cushioning element in the heel area opening. In one embodiment of the invention, the heel area opening is provided by cutting an opening in the assembled footwear. In this embodiment, a shank in the footwear is made integral with a rand. In another embodiment, the heel area opening is provided by cutting openings in the individual footwear layers, aligning the openings, and assembling the aligned layers. In this embodiment, the shank is not integral with a rand.

Accordingly, it is an object of this invention to provide an improved footwear having a cushioning element therein and the method for making the same.

Another object of this invention is to provide such an improved cushioned footwear without significantly increasing the size and aesthetic configuration of the upper.

A still further object of this invention is to provide such an improved cushioned element in footwear, without significantly increasing the size of the footwear.

Other object and attendant advantages of this invention will be readily appreciated as the same become more clearly understood by references to the following detailed description when considered in connection with the accompanying drawings in which like reference numerals designate like parts throughout the figures thereof.

BRIEF DESCRIPTION OF THE DRAWINGS

FIG. 2 is a partial rear elevation sectional view taken along line 2—2 of FIG. 1;

FIG. 3 is a side elevational schematic view illustrating the goodyear welt construction utilized in the production of the first embodiment of the footwear;

5

DETAILED DESCRIPTION OF THE PREFERRED EMBODIMENT

Figure 1:
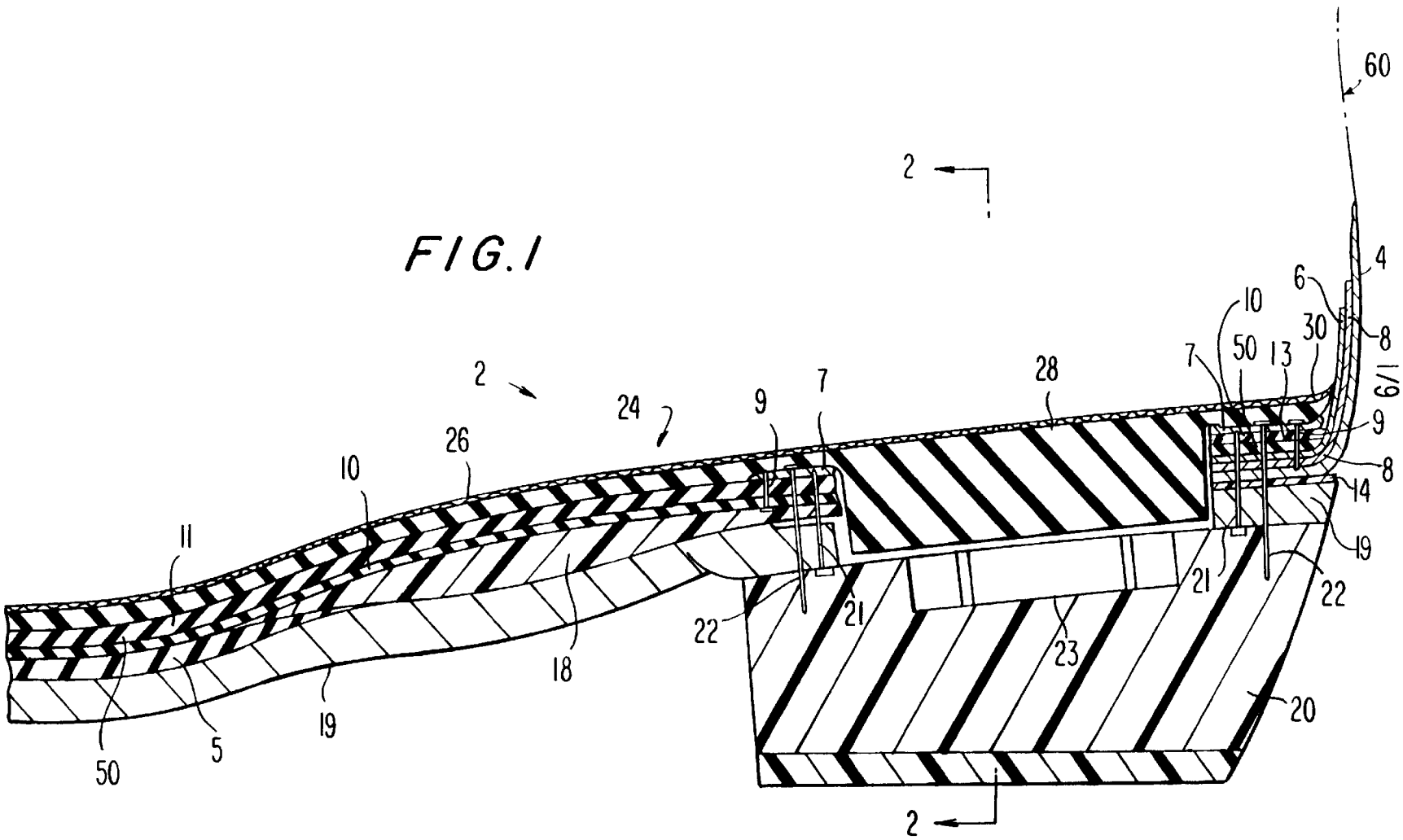
FIG. 1 is a partial side elevational sectional view of a first embodiment of the footwear embodying the present invention.

In the illustrated embodiment of FIGS. 1 and 2, there is shown footwear 2, including an upper 60, which may be formed of leather 4, a lining 6 and a counter 8 therebetween. The counter is a stiffener of leather, fiber or other material which provides permanent form to the footwear upper around the heel.

A tuck 7 is secured to the top surface of the heel portion 13 of an insole 10 and to the top surface of the rear section of a forward portion 11 of insole 10. Tuck 7 is a dense, rigid material such as laminated wood, fiberboard or stiff leather.

An insole 10 includes laminated foam material 50. A stiffened rib 3 (see FIG. 3), which may be of canvas material, extends underneath the periphery of the forward portion 11 of insole 10 and is attached thereto by means of adhesive or stitching. A bottom filler 5, which may be made from material such as cork, or sponge-like material, is secured within the interior of the forward portion of rib 3 by means of cement. Tuck 7 anchors heel seat nails 9 which secure the tuck 7, insole 10 and upper 60. The tuck 7 is required because the insole 10 is less dense and rigid than tuck 7 and could not anchor the heel seat nails 9.

The heel area of upper 60 is located between the rear portion 13 of insole 10 and a rand portion 14 of an integral rand and shank 16, which may be formed of hard plastic material. A shank portion 18 (see FIGS. 4A and 4B) of integral rand and shank 16 extends underneath the rear of the forward portion 11 of insole 10. Openings 17 in the shank 16 are for the purpose of providing a cooling chamber during the manufacturing of integral rand and shank 16. Shank portion 18 is formed with an arcuate portion 19 which creates a slightly convex hump in outsole 19 when the footwear is assembled. Outsole 19 extends beneath the bottom filler 5, the shank portion 18 of integral rand and shank 16 and the rand portion 14 of integral rand and shank 16. Gang nails 21 are provided to secure outsole 19, rand portion 14 of integral rand and shank 16, upper 60, insole 10 and tuck 7. The gang nails 21 are nailed from the bottom of outsole 19 and curled into tuck 7, so as to be anchored therein.

Figure 4A:
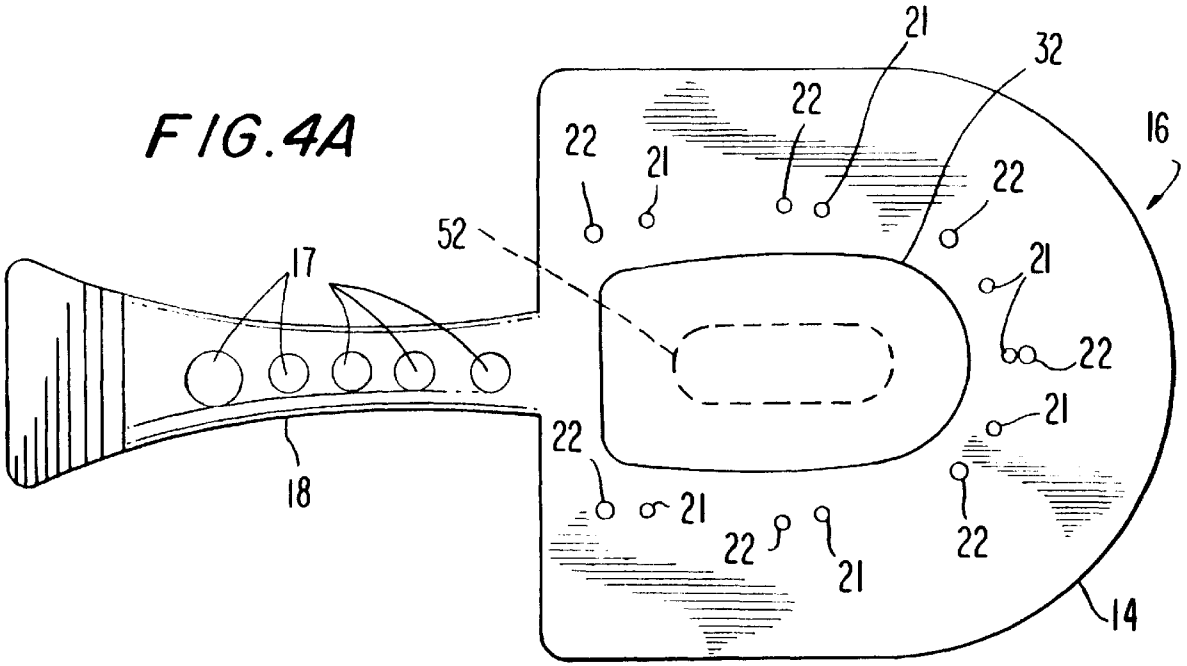
FIG. 4A is a plan view of the integral shank and rand utilized in the first embodiment of the footwear.
Figure 4B:
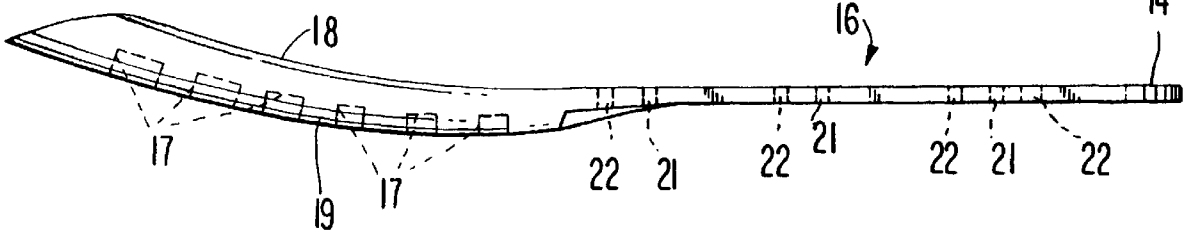
FIG. 4B is a side elevational view of the integral shank and rand utilized in the footwear shown in FIG. 1.
Figure 11:
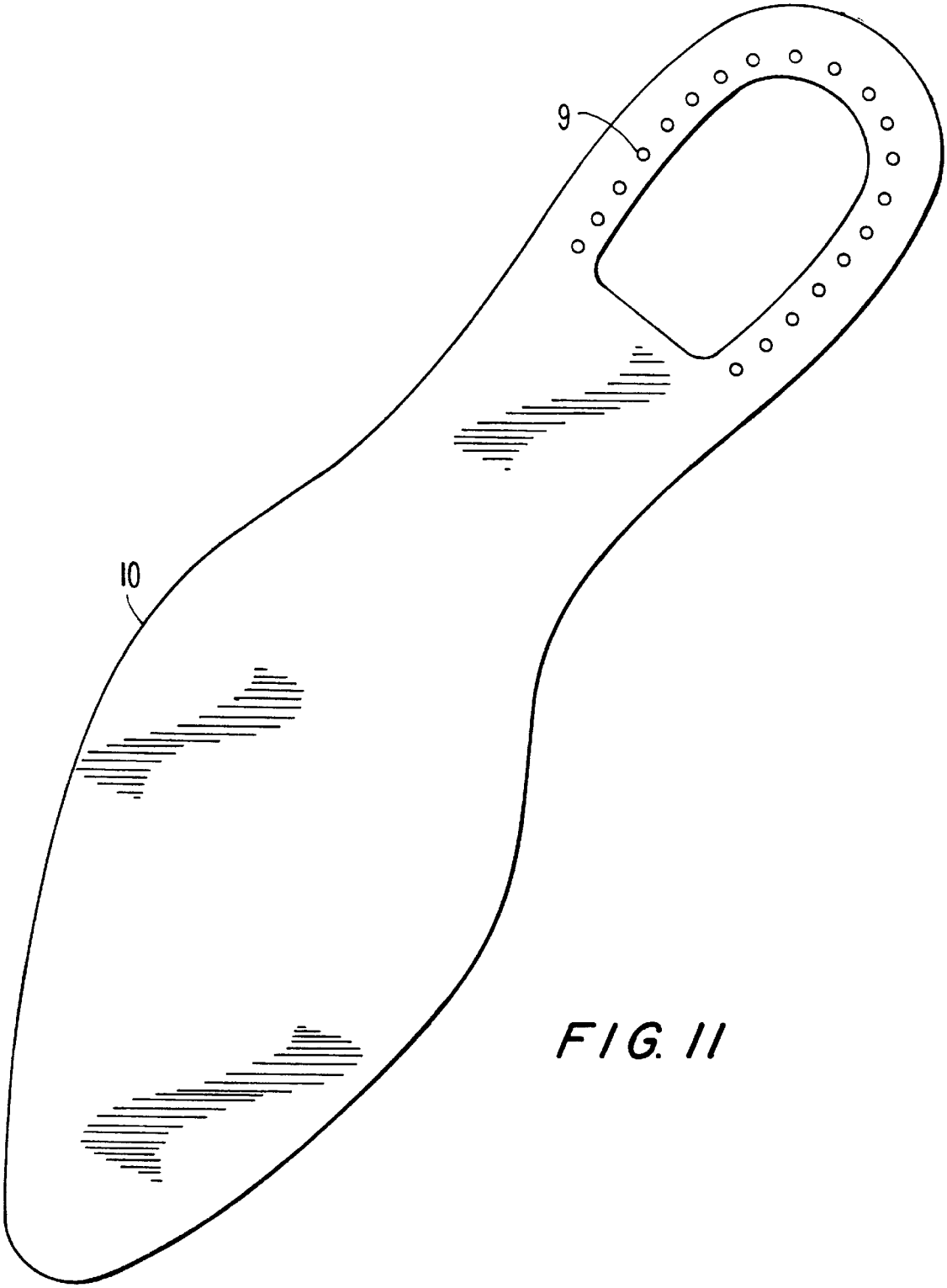
FIG. 11 is a schematic bottom view of the insole of the footwear embodying the present invention which shows the heel seat nails.

A heel 20 is nailed to footwear 2 by heel nails 22 which are nailed from the top of tuck 7. Heel 20 includes a cooling chamber 23 which enables cooling of heel 20 during the manufacturing process of the heel. Care must be taken to assure that none of the nails which form the nail pattern of heel seat nails 9, gang nails 21 or heel nails 22 extend into an opening 32, hereinafter described. A representative pattern of heel seat nails 9 is shown in FIG. 11. Representative patterns of gang nails 21 and heel nails 22 are shown in FIG. 4A and FIG. 4B.

A cushioning element 24 of foam material includes a front section 26 and a rear heel plug 28. A peripheral lip portion 30 of cushioning element 24 rests on tuck 7. Rear heel plug 28 of cushioning element 24 extends into an opening 32 formed by aligned openings in tuck 7, insole 10, rand portion 14 of integral rand and shank 16 and outsole 19. The front section 26 of cushioning element 24 rests on insole 10. The opening 32 may be formed by operation of a die under pressure.

To construct the footwear disclosed in FIG. 1, the heel area of upper 60 is backpart lasted so that about ½ inch to ⅝ inch is turned inward around the heel area. The insole 10, with the stiffened rib 3 on the bottom thereof, is tacked to the bottom of a standard last which includes an additional thickness of approximately ⅛ inch added to the bottom to permit the footwear to accommodate the thickness of the cushioning element 24.

The upper 60 is then placed over the last and the vamp (toe area) of the upper 60 is cemented to the rib 3. The upper 60 between the toe area and the heel area is stapled, or side lasted, to rib 3. The heel seat nails 9 secure the upper 60 and insole 10 to tuck 7. Tuck 7 need only be of a size that will accommodate the nailing pattern of the heel seat nails 9, the gang nails 21 and the heel nails 22. It is desirable that tuck 7 not extend to the flex area of the foot. The heel seat nails 9 are nailed from the bottom of the upper 60 and the nails points are curled into tuck 7 so as to be anchored therein.

A welt 34 (see FIG. 3) is then stitched to stiffened rib 3 through the upper 60. Bottom filler 5 and the integral rand and shank 16 (see FIGS. 4A and 4B), without the opening 32 therein, are cemented in place on the bottom of insole 10.

Gang nails 21 secure outsole 19, rand portion 14 of integral rand and shank 16, upper 60, insole 10 and tuck 7. At this juncture, integral rand and shank 16 includes an opening 52 (shown in dotted lines in FIG. 4A) smaller than the size of the opening 32, for the purpose of relieving the pressure on the die when opening 32 is subsequently formed. The gang nails 21 are nailed from the bottom of outsole 19 and curled into tuck 7 so as to be anchored therein.

The outsole 19 is pressed into place against the bottom filler 5 and integral rand and shank 16, using a pressure and heat sensitive adhesive, and the outsole 19 is stitched to the welt 34. The partially completed footwear 2 is then removed from the last. The opening 32 is then formed as, for example, by means of a die, through tuck 7, insole 10, rand portion 14 of integral rand and shank 16, and outsole 19. Heel 20 is nailed to footwear 2 by heel nails 22. Care must be taken to assure that the nail pattern of heel nails 22 avoid opening 32. Cushioning element 24 is placed on the top forward surface of insole 10 and on the top surface of tuck 7, with rear heel plug 28 of cushioning element 24 extending into opening 32.

Figure 5:
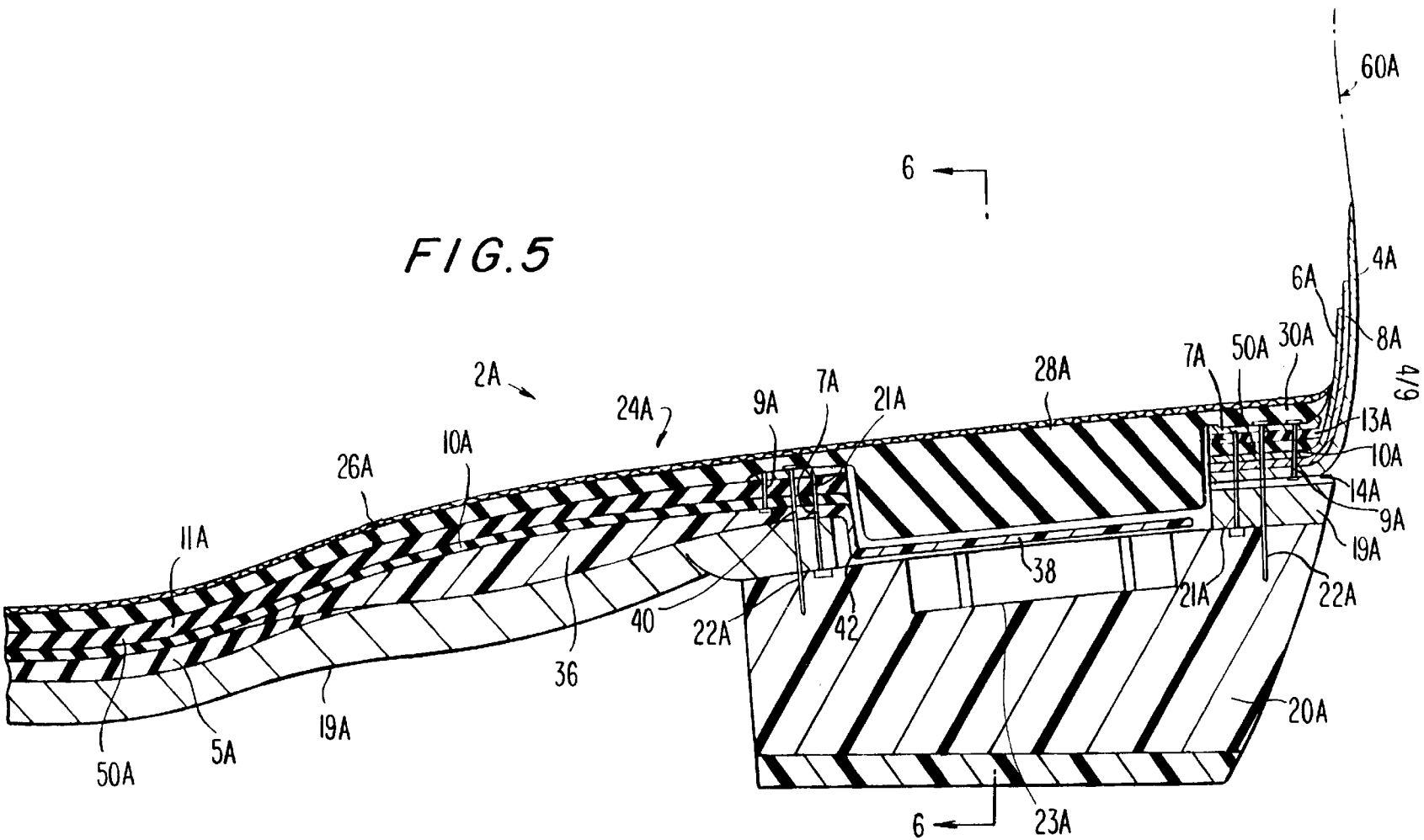
FIG. 5 is a partial side elevational sectional view of a second embodiment of footwear embodying the present invention.
Figure 6:
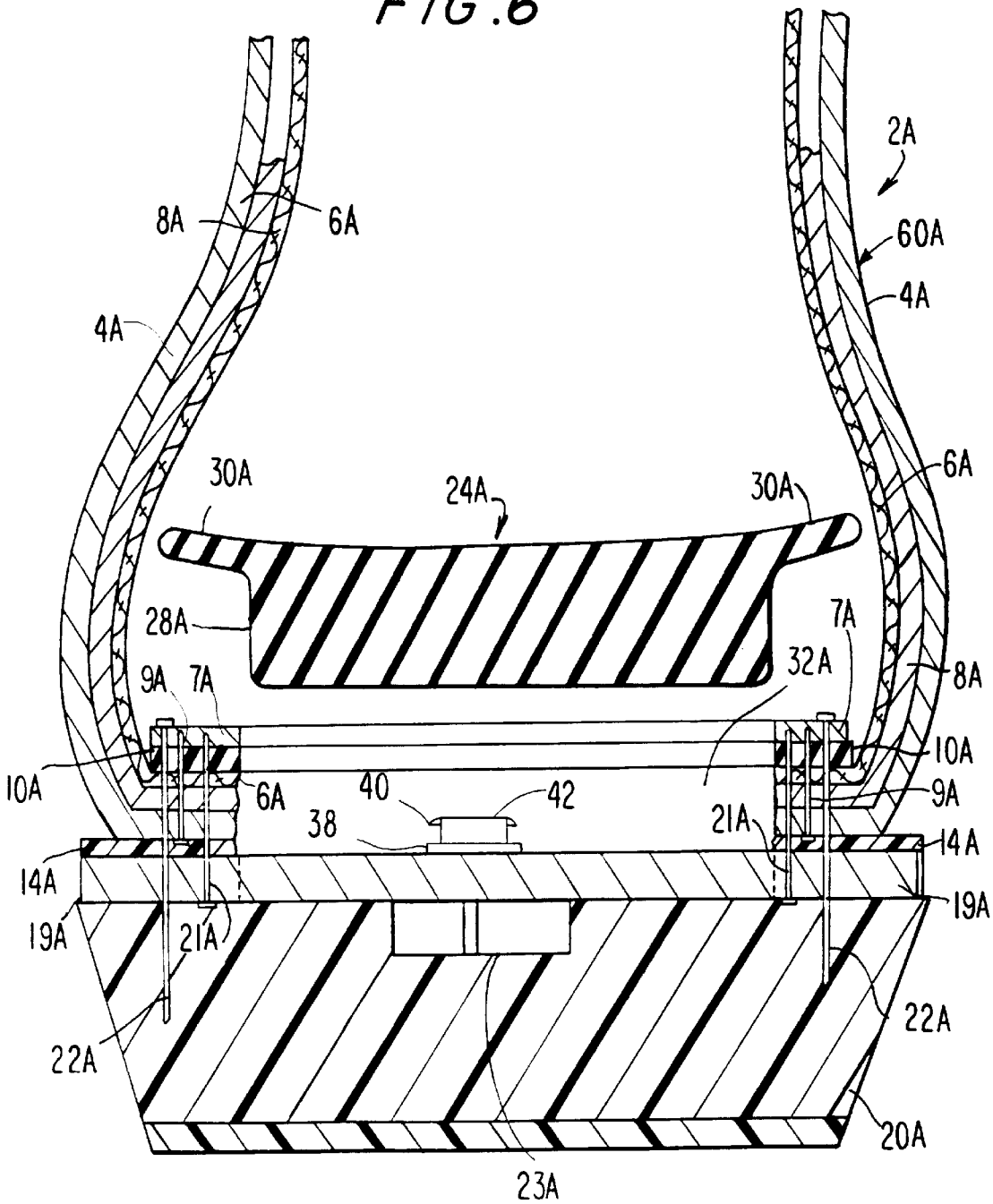
FIG. 6 is a partial rear elevational sectional view taken along line 6—6 of FIG. 5.

The footwear embodiment shown in FIG. 5 is similar to that shown in FIG. 1 and to the extent the same element appears in FIG. 5 and FIG. 1, the reference numeral used in FIG. 5 will be the same as the reference numeral used in FIG. 1, except that the letter "A" will be added to the reference numeral in FIG. 5.

A tuck 7A is secured to the top surface of the heel portion 13A of an insole 10A and to the top surface of the rear section of a forward portion 11A of insole 10A. Tuck 7A is a dense, rigid material such as laminated wood, fiberboard or stiff leather.

Figure 7:
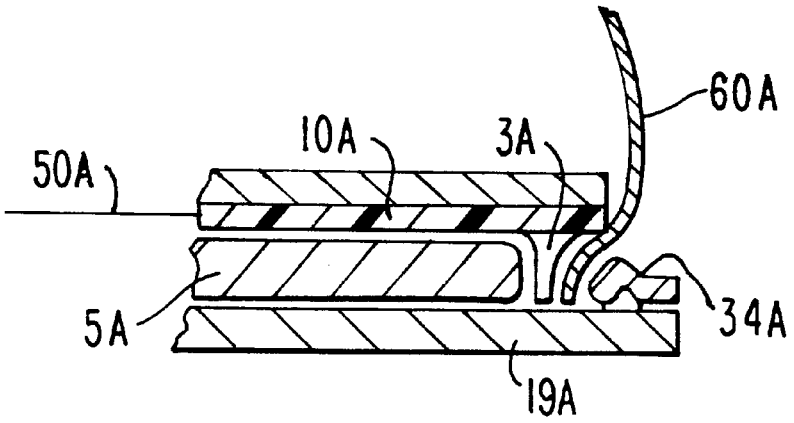
FIG. 7 is a side elevational schematic view illustrating the goodyear welt construction utilized in the production of the second embodiment of the footwear.

An insole 10A includes laminated foam material 50A. A stiffened rib 3A (see FIG. 7), which may be of canvas material, extends underneath the periphery of the forward portion 11A of insole 10A and is attached thereto by means of adhesive or stitching. A bottom filler 5A, which may be made from material such as cork, or sponge-like material, is secured within the interior of rib 3A as by means of cement). Tuck 7A anchors heel seat nails 9A which secure the tuck 7A, insole 10A and upper 60A. The tuck 7A is required because the insole 10A is less dense and rigid than tuck 7 and could not anchor the heel seat nails 9A.

Figure 8:
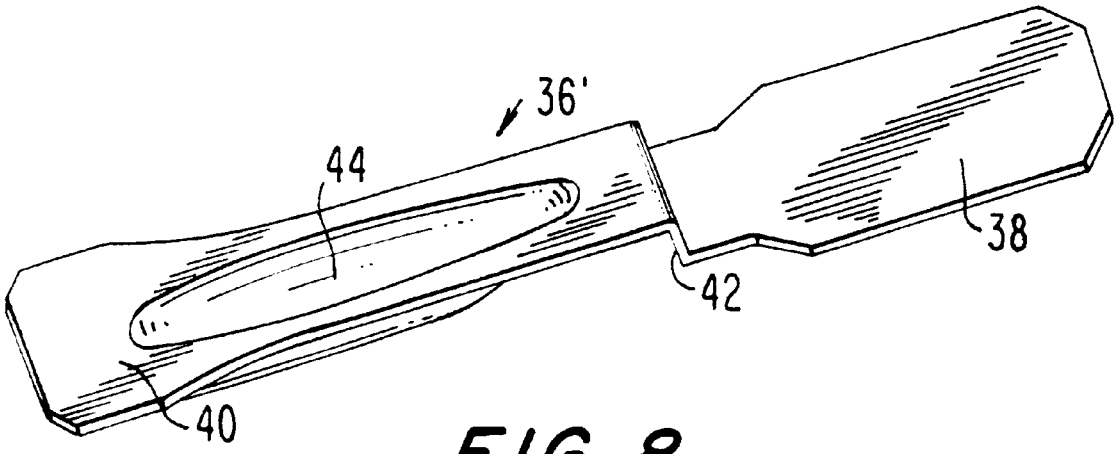
FIG. 8 is a perspective view of the shank utilized in the footwear shown in FIG. 5.

The heel area of upper 60A is located between the rear portion 13A of insole 10 and a rand 14A. A shank 36 (see FIG. 8), which may be formed of metal, extends underneath the rear of the forward portion 11A of insole 10A. Shank 36 comprises a rear section 38 and a front section 40, connected by a riser 42. A depression 44 may be formed in front section 40 of shank 36 to create a slight convex hump in the outsole 19A, when the footwear is assembled. Shank 36 provides rigid support to the wearer and the rear section 38 of shank 36 serves as a stop for rear heel plug 28A of cushioning element 24A. Outsole 19A extends beneath the bottom filler 5, the shank 36 and the heel area of upper 60A. Gang nails 21A are provided to secure outsole 19A, rand 14A, upper 60A, insole 10A and tuck 7A. The gang nails 21A are nailed from the bottom of outsole and curled into tuck 7A so as to be anchored therein.

A heel 20A is nailed to footwear 2A by heel nails 22A which are nailed from the top of tuck 7A. Heel 20A includes a cooling chamber 23A which enables cooling of heel 20A during the manufacturing process of the heel. Care must be taken to assure that none of the nails which form the nail pattern of heel seat nails 9A, gang nails 21A or heel nails 22A extend into an opening 32A, hereinafter described. A representative pattern of heel seat nails 9A is the same as that disclosed by the heel seat nails 9 shown in FIG. 11. Likewise, representative patterns of gang nails 21A and heel nails 22A are the same as disclosed by the gang nails 21 and heel nails 22 shown in FIGS. 4A and 4B.

A cushioning element 24A of foam material includes a front section 26A and a rear heel plug 28A. Openings in the shape of rear heel plug 28A are formed in tuck 7A, insole 10A, rand 14A and outsole 19A. Such openings may be formed by use of a die under pressure. A peripheral lip portion 30A of cushioning element 24A rests on tuck 7A. Rear heel plug 28A of cushioning element 24A extends into the opening 32A formed by the openings in tuck 7A, insole 10A, rand portion 14A, and outsole 19A. The front section 26A of cushioning element 24A rests on insole 10A.

Figure 9:
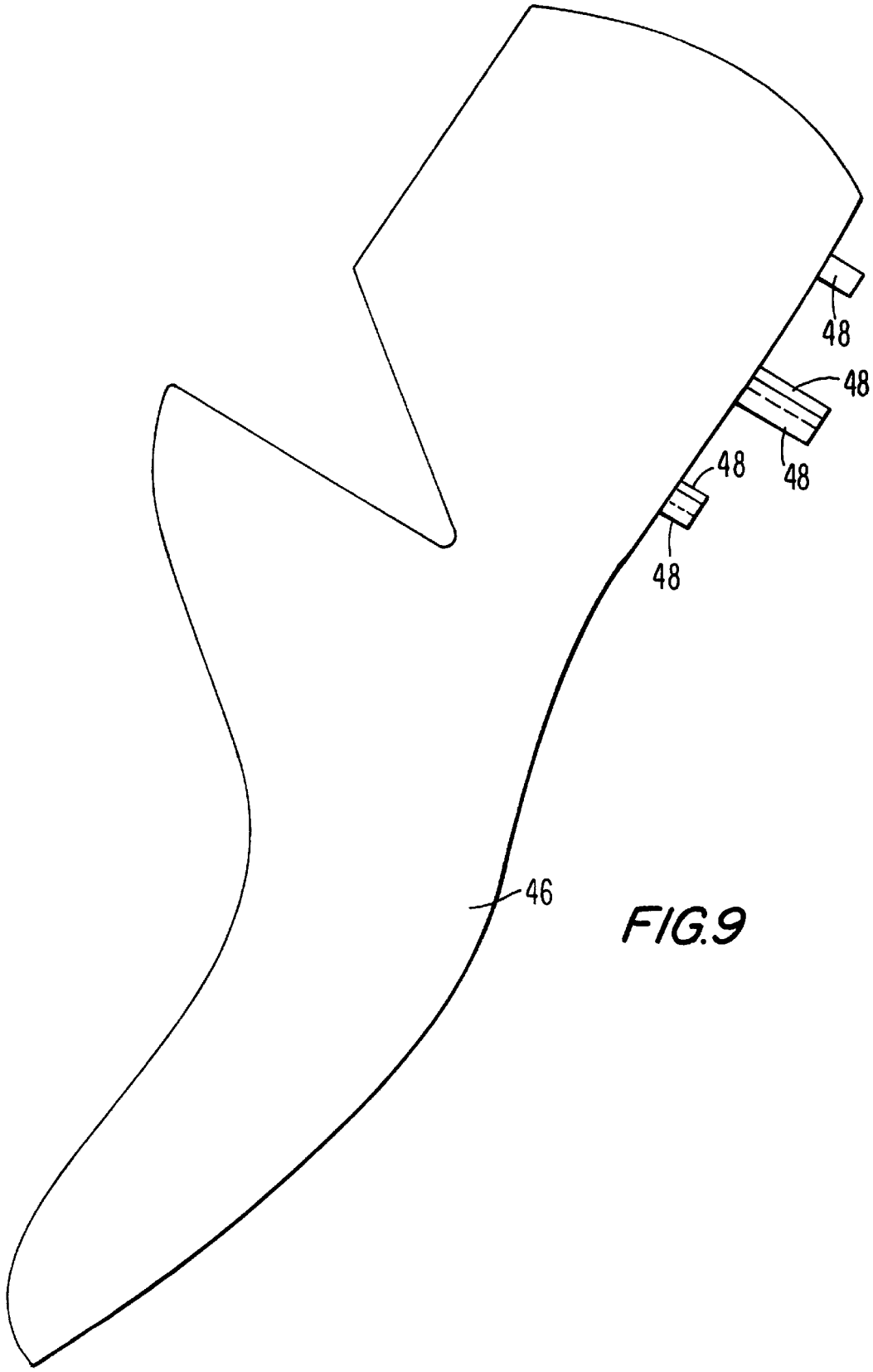
FIG. 9 is a partial side elevational view of a last used to produce the footwear shown in FIG. 5.
Figure 10:
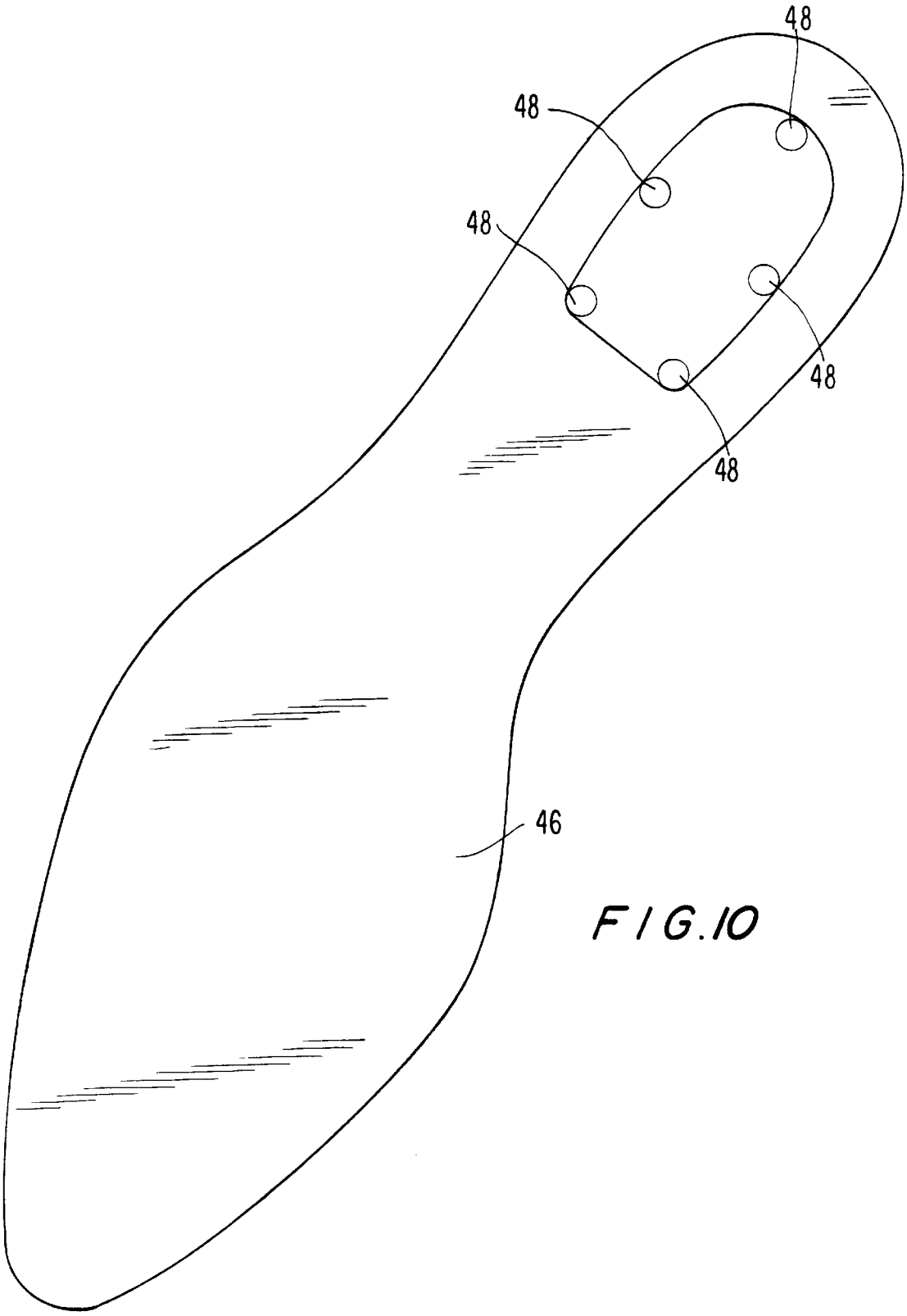
FIG. 10 is a partial bottom elevational view of a last used to produce the footwear shown in FIG. 5.

To construct the footwear disclosed in FIG. 5, an opening 32A the shape of rear heel plug 28A of cushioning element 24A is cut separately (as by use of a die under pressure) into the tuck 7A, the insole 10A, rand 14A and the outsole 19A. The heel area of upper 60A is backpart lasted so that about ½ inch to ⅝ inch is turned inward around the heel area. The insole 10A, with the stiffened rib 3A on the bottom thereof, is tacked to the bottom of a standard last 46 having pins 48 (see FIG. 9) thereon which are arranged in a pattern to fit snugly within opening 32A formed by the aligned openings in tuck 7A, insole 10A, rand 14A, and outsole 19A. The most rearward pin 48 of last 46 is of shorter length than the middle pins 48 in order to facilitate removal of the footwear from the last. The two most forward pins 48 may also be made of shorter length than the middle pins 48, if that is required, to avoid forward pins 48 from interfering with the welt production process. The peripheral edge of opening 32A in tuck 7A, insole 10A, rand 14A and outsole 19A, surrounds pins 48 on last 46. Care must be taken to assure that the opening 32A in tuck 7A, insole 10A, rand 14A and outsole 19A surrounds pins 48 of last 46. The last 46 includes an additional thickness of approximately ⅛ inch added to the bottom to permit the footwear to accommodate the thickness of the cushioning element 24A.

The upper 60A is placed over last 46 and the vamp (toe area) of the upper 60A is cemented to the rib 3A. The upper 60A between the toe area and the heel area is stapled, or side lasted, to rib 3A. The heel seat nails 9A secure the upper 60A and insole 10A to tuck 7A. Tuck 7A need only be of a size that will accommodate the nailing pattern of the heel seat nails 9A, the gang nails 21A and the heel nails 22A. It is desirable that tuck 7A not extend to the flex area of the foot. The heel seat nails 9A are nailed from the bottom of the upper 60A and the nail points are curled into tuck 7A so as to be anchored therein.

A welt 34A (see FIG. 7) is then stitched to stiffened rib 3A through the upper 60A. Bottom filler 5A and shank 36 are cemented in place on the bottom of insole 10.

Gang nails 21A secure outsole 19A, rand 14A, upper 60A, insole 10A and tuck 7A. The gang nails 21A are nailed from the bottom of outsole 19A and curled into tuck 7A so as to be anchored therein.

The outsole 19A is pressed into place against the bottom filler 5A and shank 36, using a pressure and heat sensitive adhesive, and the outsole 19 is stitched to the welt 34. The partially completed footwear 2A is then removed from the last and heel 20A is nailed to footwear 2A by nails 22A. Care must be taken to assure that none of the nails which form the nail patterns of heel seat nails 9A, gang nails 21A or heel nails 22A extend into openings 32A. Cushioning element 24A is placed on the top surface of insole 10A and tuck 7A, with rear heel plug 28A of cushioning element 24A extending into opening 32A.

Obviously many modifications and variations of the present invention are possible in the light of the above teachings. It is therefore understood that, within the scope of the appended claims, the invention may be practiced otherwise than as specifically described.

We claim:

1. An improved footwear of goodyear welt construction including an upper, an insole having a forward and rear heel portion and an opening in the heel portion thereof, an outsole having a forward and rear heel portion and an opening thereof in alignment with said opening in the heel portion of the insole, a heel, nails which extend into the heel portion of said insole and said outsole but not into the openings in the heel portion of said insole and said outsole and a cushioning element which overlies said insole and has a heel plug which extends into the openings in said insole and said outsole.

2. An improved footwear as recited in claim 1 wherein said nails secure the insole and outsole to the heel.

3. An improved footwear as recited in claim 1 and further including a tuck having an opening therein, said opening in the tuck being in alignment with the opening in the heel portion of the insole and with the opening in the heel portion of the outsole.

4. An improved footwear as recited in claim 3, wherein said nails comprise heel seat nails which secure the tuck, upper and insole together.

5. An improved footwear as recited in claim 3, wherein said nails comprise gang nails which secure the tuck, insole and outsole together.

6. An improved footwear as recited in claim 1, wherein said footwear includes a shank.

7. An improved footwear as recited in claim 6, wherein said shank is formed integral with a rand having an opening therein, said opening in the rand being in alignment with the opening in the heel portion of the insole and the heel portion of the outsole.

8. An improved footwear as recited in claim 7, wherein said nails secure the insole and outsole to the heel.

9. An improved footwear as recited in claim 8 and further including a tuck having an opening therein, said opening in the tuck being in alignment with the opening in the heel portion of the insole, with the opening in the heel portion of the outsole, and with the opening in the rand.

10. An improved footwear as recited in claim 9, wherein said nails comprise heel seat nails which secure the tuck, upper, insole and integral shank and rand together.

11. An improved footwear as recited in claim 10, wherein said nails comprise gang nails which secure the tuck, insole, integral shank and rand and outsole together.

12. An improved footwear as recited in claim 6 wherein a first portion of said shank extends rearwardly to the opening formed by said opening in the heel portion of said insole and the opening in the heel portion of said outsole.

13. An improved footwear as recited in claim 12 wherein said shank includes a second portion extending downwardly from said first portion into the opening formed by said opening in the heel portion of said insole and the opening in the heel portion of said outsole.

14. An improved footwear as recited in claim 13 wherein said shank includes a third portion which extends rearwardly from said second portion at the bottom of the opening formed by said opening in the heel portion of said insole and the opening in the heel portion of said outsole.

15. An improved footwear as recited in claim 14, wherein said nails secure the insole and outsole to the heel.

16. An improved footwear as recited in claim 15 and further including a tuck having an opening therein, said opening in the tuck being in alignment with the opening in the heel portion of the insole and the opening in the heel portion of the outsole.

17. An improved footwear as recited in claim 16 wherein said nails comprise heel seat nails which secure the tuck, upper and insole together.

18. An improved footwear as recited in claim 17 wherein said nails comprise gang nails which secure the tuck, insole and outsole together.

19. An improved footwear of goodyear welt construction including an upper, an insole having a forward and rear heel portion and an opening in the heel portion thereof, an outsole having a forward and rear heel portion and an opening thereof in alignment with said opening in the heel portion of the insole, a shank, and a cushioning element having a heel plug which extends into the openings in said insole and said outsole.

20. An improved footwear as recited in claim 19 wherein said shank is formed integral with a rand having an opening therein, said opening in the rand being in alignment with the opening in the heel portion of the insole and the heel portion of the outsole.

21. An improved footwear as recited in claim 19 wherein a first portion of said shank extends rearwardly to the opening formed by said opening in the heel portion of said insole and the opening in the heel portion of said outsole.

22. An improved footwear as recited in claim 21 wherein said shank includes a second portion extending downwardly from said first portion into the opening formed by said opening in the heel portion of said insole and the opening in the heel portion of said outsole.

23. An improved footwear as recited in claim 22 wherein said shank includes a third portion which extends rearwardly from said second portion at the bottom of the opening formed by said opening in the heel portion of said insole and the opening in the heel portion of said outsole.

* * * * *